US005876073A

United States Patent [19]

Geringer et al.

[11] Patent Number: 5,876,073

[45] Date of Patent: Mar. 2, 1999

[54] ELECTRICALLY OPERABLE DOOR LOCKING APPARATUS AND METHOD FOR OPERATING THE SAME

[76] Inventors: Arthur Geringer, 5029 E. Jacobs Ct., Agoura, Calif. 91301; Richard Geringer, 12628 Ambermeadow St., Moorpark, Calif. 93021; David Geringer, 28364 Balkin, Agoura, Calif. 91301

[21] Appl. No.: 851,827

[22] Filed: May 5, 1997

[51] Int. Cl.[6] ..... E05G 1/06

[52] U.S. Cl. ..... 292/144; 292/251.5

[58] Field of Search ..... 292/144, 150, 292/245, 169.15, 170, 182, 244, DIG. 53; 70/277, 279

[56] References Cited

U.S. PATENT DOCUMENTS

| | | | |
|---|---|---|---|
| 2,786,701 | 3/1957 | Povlich | 292/144 |
| 3,166,144 | 1/1965 | Price . | |
| 3,361,462 | 1/1968 | Foster | 292/165 |
| 4,021,065 | 5/1977 | Geringer | 292/144 |
| 4,390,197 | 6/1983 | Butts | 292/144 |
| 4,579,376 | 4/1986 | Charlton | 292/144 |
| 5,228,730 | 7/1993 | Gokcebay | 292/144 |
| 5,246,258 | 9/1993 | Kerschenbaum | 292/144 |
| 5,474,348 | 12/1995 | Palmer | 292/339 |

*Primary Examiner*—Steven Meyers
*Assistant Examiner*—Gary Estremsky
*Attorney, Agent, or Firm*—John J. Posta, Jr.

[57] ABSTRACT

An electrically operable door lock apparatus is disclosed which may be installed on a door through which access is to be controlled by an electrically operable security system, whereby the door opening mechanism is selectively locked and unlocked by controlling the supply of electricity to the door locking mechanism to thereby control access or egress through the door. The electrically operable door lock apparatus uses an electromagnetic actuator to drive a locking member in reciprocating movement between a locked position in which it engages a latch actuating member to prevent it from being rotated to retract a latch bolt to open a door, and an unlocked position in which it is disengaged from the latch actuating member to allow it to be rotated to retract the latch bolt to open the door. By reversing the position of the electromagnetic actuator in the door lock apparatus, the system may operate in either a fail secure mode in which the electromagnetic actuator must be powered to unlock the door, or a fail safe mode in which the electromagnetic actuator must be powered to lock the door.

14 Claims, 4 Drawing Sheets

FIG. 5
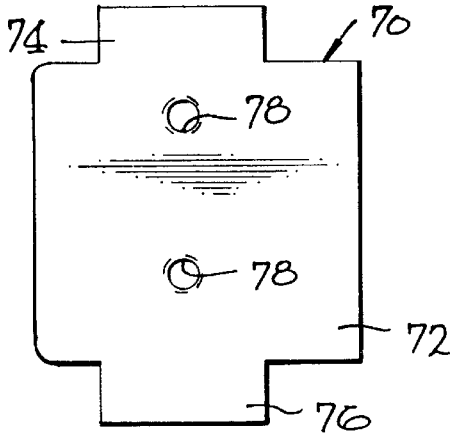
FIG. 6
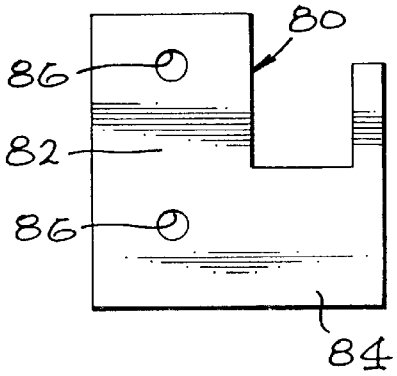
FIG. 8
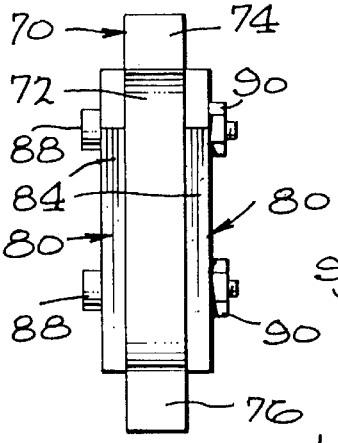
FIG. 9
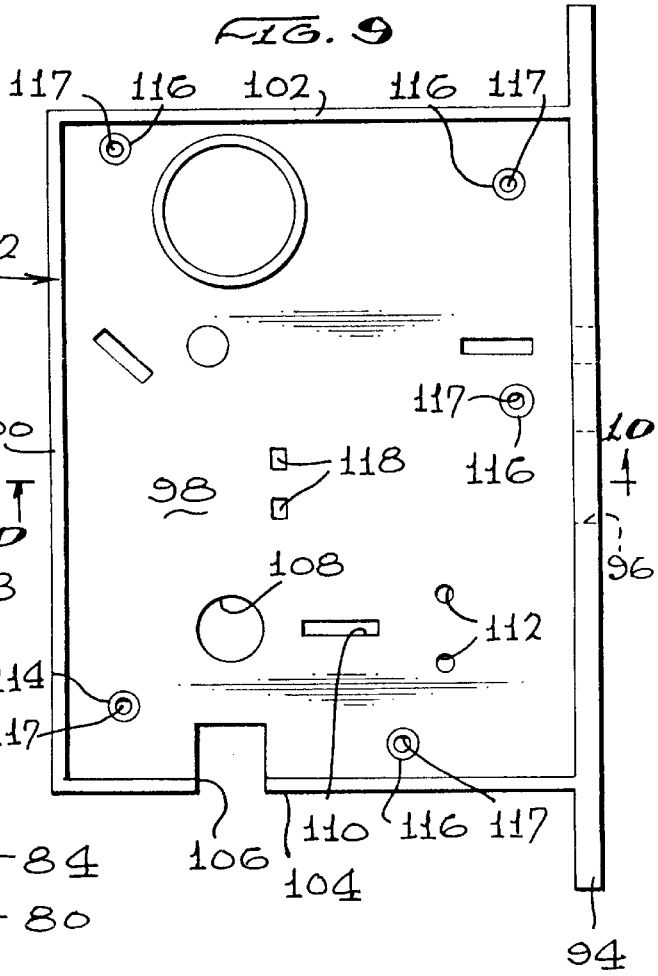
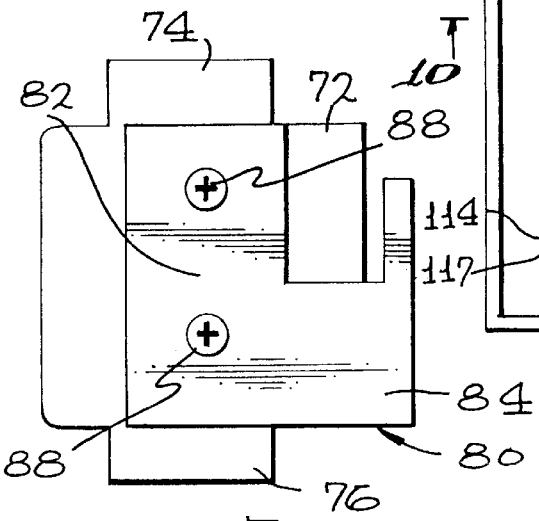
FIG. 7

ELECTRICALLY OPERABLE DOOR LOCKING APPARATUS AND METHOD FOR OPERATING THE SAME

BACKGROUND OF THE INVENTION

Field of the Invention

The present invention relates generally to electrically operable security systems in which a door is unlocked by accessing an electronic control system, and more particularly to an improved electrically operable door lock which may be installed on a door through which access is to be controlled by an electrically operable security system, whereby the door opening mechanism is selectively locked and unlocked by controlling the supply of electricity to the door locking mechanism to thereby control access or egress through the door.

Security doors to prevent theft or vandalism have evolved over the years from simple doors with heavy duty locks to more sophisticated egress and access control devices. Hardware and systems for limiting and controlling egress and access through doors are generally utilized for theft-prevention or to establish a secured area into which (or from which) entry is limited. For example, stores use such secured doors in certain departments (such as, for example, the automotive department) which may not always be manned to prevent thieves from escaping through the door with valuable merchandise. In addition, industrial companies also use such secured exit doors to prevent pilferage of valuable equipment and merchandise.

One type of door lock which has been used in the past to control egress and access through a door is an electromagnetic system which utilizes an electromagnet mounted on a door jamb, with an armature mounted on the door held by the electromagnet to retain the door in the closed position when the electromagnet is actuated. Such locking mechanisms are illustrated in U.S. Pat. No. 4,439,808, to Gillham, U.S. Pat. No. 4,609,910, to Geringer et al., U.S. Pat. No. 4,652,028, to Logan et al., U.S. Pat. No. 4,720,128 to Logan, Jr., et al., and U.S. Pat. No. 5,000,497, to Geringer et al. All of these references utilize an electromagnet mounted in or on a door jamb and an armature on the door held by the electromagnet to retain the door in the closed position. Such electromagnetic locking systems are quite effective at controlling egress and access through the door they are installed on. Unfortunately, however, such systems are quite expensive, and require a fairly complex installation, often with the electromagnet being mounted in the door jamb.

Another type of system which is known in the art is the electric door strike release mechanism, in which a latch bolt located in and extending from a locking mechanism located in a door is receivable in an electrically operable door strike mounted in the frame of the door. The door may be opened either by retracting the latch bolt into the locking mechanism to thereby disengage it from the door strike, or by electrically actuating the door strike mechanism to cause it to open and to thereby release the extended latch bolt from the door strike mechanism. Typically, such electrically operable door strikes pivot to allow the door to close without the door strike mechanism being electrically actuated. Such door strike mechanisms are illustrated in U.S. Pat. No. 4,017,107, to Hanchett, U.S. Pat. No. 4,626,010, to Hanchett et al., and in U.S. Pat. No. 5,484,180, to Helmar. Like the electromagnet/armature systems discussed above, electrically operated door strike systems are also expensive, and require a significant installation into the door jamb, which must usually be reinforced.

It is accordingly the primary objective of the present invention that it provide an electrically operable door lock apparatus, and a method for the operation thereof, which may be installed into a standard door in place of a regular lockset. It is a related objective of the electrically operable door lock apparatus of the present invention that it comprise a single module which may be easily installed in the conventional manner into a door (save for the installation of a pair of wires), with a standard strike plate (and no other apparatus) being mounted in the door frame. It is an additional objective of the present invention that the electrically operable door lock apparatus may be operated by turning a knob or handle in a manner like that of a conventional lockset, except that the use of the knob or handle to open the door may be selectively enabled or disabled through the use of the electrical locking mechanism.

It is a further principal objective of the electrically operable door lock apparatus of the present invention that it be selectively adaptable to operate in either a fail safe mode of operation in which the door will be locked when electrical power is supplied to the door lock apparatus and unlocked when electrical power is not supplied, or a fail secure mode of operation in which the door will be unlocked when electrical power is supplied to the door lock apparatus and locked when electrical power is not supplied. It is a related objective of the present invention that these two alternate modes of operation be user selectable prior to installation of the electrically operable door lock apparatus into the door without requiring the use of additional or alternate components. It is yet another related objective of the electrically operable door lock apparatus of the present invention that the selection of the operating mode be relatively easy to accomplish using only simple hand tools.

The electrically operable door lock apparatus of the present invention must be of a construction which is both durable and long lasting, and it should also require little or no maintenance throughout its operating lifetime. In order to enhance the market appeal of the electrically operable door lock apparatus of the present invention, it should also be of inexpensive construction to thereby afford it the broadest possible market. Finally, it is also an objective that all of the aforesaid advantages and objectives of the electrically operable door lock apparatus of the present invention be achieved without incurring any substantial relative disadvantage.

SUMMARY OF THE INVENTION

The disadvantages and limitations of the background art discussed above are overcome by the present invention. With this invention, an electrically operable door lock apparatus is provided which resembles a conventional lockset in all respects save one: it has a pair of wires extending therefrom which are used to actuate a locking mechanism contained inside the door lock apparatus. The housing of the electrically operable door lock apparatus of the present invention is of rectangular configuration, and is relatively thin to facilitate its installation into a door.

In its other conventional aspects, the electrically operable door lock apparatus is designed to accept a rectangular (in cross-section) driver spindle having knobs or handles mounted thereupon at each end thereof. (If desired, it is well known in the art that the rectangular drive spindle can be made to project from a single side of the lock housing only, with only a single knob or handle being used such that the door may be opened from one side only.) A latch actuating cam member, which is mounted inside the lock housing for rotation about a fixed axis, has a rectangular aperture located therein. The rectangular aperture in the latch actuating cam member is designed to accept a rectangular driver spindle therein, thereby allowing the latch actuating cam member to be rotated whenever a knob or handle located on an end of the rectangular driver spindle is turned.

The latch actuating cam member bears against a spring-biased latch actuating arm which has a first end rotatably mounted on a pivot pin extending from the lock housing. When the latch actuating cam member is rotated (in either direction), it will urge the latch actuating arm to rotate against the force of the spring such that a second end of the latch actuating arm moves from a first position to a second position. The second end of the latch actuating arm bears against a flange located at a first end of a latch bolt actuating shaft having a latch bolt mounted at a second end thereof. The latch bolt is spring-biased into a deployed position in which it extends from the lock housing. When the latch actuating arm moves from its first position to its second position, the second end of the latch actuating arm engages the flange mounted at the first end of the latch bolt actuating shaft to draw the latch bolt into the lock housing into a retracted position.

Thus, it is apparent that the rotation of the latch actuating cam member will cause the latch actuating arm to draw the latch bolt from its deployed direction to its retracted position. Conventional lock design dictates that the latch bolt in the lock housing which is mounted in a door will engage a strike plate mounted in the frame of the door when the door is closed and the latch bolt is in its deployed position. Similarly, when the latch bolt is retraced from engagement with the strike plate in the door frame and is drawn into the lock housing, the door may be freely opened.

While conventional locksets use a mechanical locking mechanism, the electrically operable door lock apparatus of the present invention uses an electromagnetic locking mechanism. The latch actuating cam member has a notch located in a side thereof which is opposite the location of the latch actuating arm. A flat locking member is mounted for movement between a locked position in which the locking member engages the slot located in the latch actuating cam member, thereby preventing its rotation, and an unlocked position in which the locking member is fully retracted from the slot located in the latch actuating cam member, thereby allowing it to rotate.

The locking member is adapted to be driven between its locked and unlocked positions by a small electromagnetic actuator. This actuator consists of a solenoid installed in an iron housing, with an iron armature having a shaft mounted thereon mounted for reciprocating movement into and out of a first side of the solenoid. The shaft mounted on the armature extends through the solenoid and has its free end visible on a second side of the solenoid opposite the first side thereof. The armature is spring-biased out of the first side of the solenoid.

When the solenoid is not energized, the armature is spring biased out of the first side of the solenoid, and the free end of the shaft mounted on the armature is located close to the second side of the solenoid. Conversely, when the solenoid is energized, the armature is drawn partially into the first end of the solenoid, and the free end of the shaft moves outwardly away from the second end of the solenoid. Both the armature and the free end of the shaft are adapted to be capable (in alternate placements of the electromagnetic actuator) of engaging and driving the locking member between its locked and unlocked positions. The iron housing that the solenoid is mounted may be mounted in the lock housing with either the armature or the free end of the shaft engaging and driving the locking member.

By using the armature to drive the locking member, the locking member will be in its locked position when the solenoid is not energized, and will be driven to its unlocked position when the solenoid is energized. This first mode of operation is referred to as the fail secure mode, since if there is a power failure, the electrically operable door lock apparatus will be locked.

By using the free end of the shaft to drive the locking member, the locking member will be in its unlocked position when the solenoid is not energized, and will be driven to its locked position when the solenoid is energized. This second mode of operation is referred to as the fail safe mode, since if there is a power failure (caused, for example, by a fire or other emergency situation), the electrically operable door lock apparatus will be unlocked (thereby allowing free egress and access in case of an emergency).

It may therefore be seen that the present invention teaches an electrically operable door lock apparatus, and a method for the operation thereof, which may be installed into a standard door in place of a regular lockset. The electrically operable door lock apparatus of the present invention comprises a single module which may be easily installed in the conventional manner into a door (save for the installation of a pair of wires), with a standard strike plate (and no other apparatus) being mounted in the door frame. The electrically operable door lock apparatus of the present invention may be operated by turning a knob or handle in a manner like that of a conventional lockset, except that the use of the knob or handle to open the door may be selectively enabled or disabled through the use of the electrical locking mechanism.

The electrically operable door lock apparatus of the present invention is also selectively adaptable to operate in either a fail safe mode of operation in which the door will be locked when electrical power is supplied to the door lock apparatus and unlocked when electrical power is not supplied, or a fail secure mode of operation in which the door will be unlocked when electrical power is supplied to the door lock apparatus and locked when electrical power is not supplied. These two alternate modes of operation are user selectable prior to installation of the electrically operable door lock apparatus of the present invention into the door without requiring the use of additional or alternate components. The selection of the operating mode of choice is relatively easy to accomplish in the electrically operable door lock apparatus of the present invention, with only simple hand tools being required.

The electrically operable door lock apparatus of the present invention is of a construction which is both durable and long lasting, and which will require little or no maintenance throughout its operating lifetime. The electrically operable door lock apparatus of the present invention is also of inexpensive construction to enhance its market appeal and to thereby afford it the broadest possible market. Finally, all of the aforesaid advantages and objectives of the electrically operable door lock apparatus of the present invention are achieved without incurring any substantial relative disadvantage.

DESCRIPTION OF THE DRAWINGS

These and other advantages of the present invention are best understood with reference to the drawings, in which:

FIG. 5 is a plan view of a locking member;

FIG. 6 is a plan view of a retaining member having an engaging arm extending therefrom;

FIG. 7 is a plan view of the locking member illustrated in FIG. 5 with one of the retaining members illustrated in FIG. 6 mounted on each side thereof using a pair of bolts;

FIG. 8 is a side view of the assembled locking member and retaining members illustrated in FIG. 7;

FIG. 9 is a plan view of a lock housing which is open on one side thereof;

DETAILED DESCRIPTION OF THE PREFERRED EMBODIMENT

Figure 1:
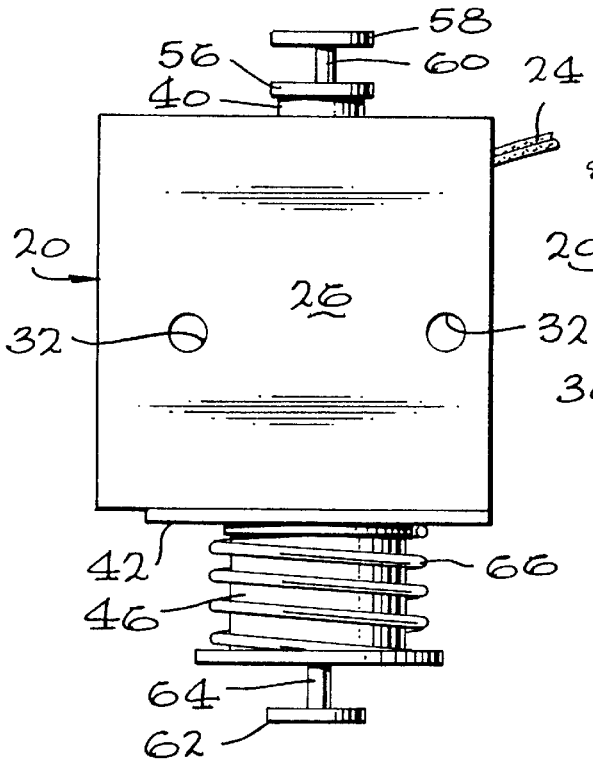
FIG. 1 is a top plan view of an electromagnetic actuator used in the electrically operable door lock apparatus of the present invention, showing a spring-biased armature extending from an iron housing on a first end thereof, and a free end of a shaft mounted on the armature extending from a second side of the iron housing, and also showing a pair of threaded apertures located in the top side of the iron housing.

The preferred embodiment of the electrically operable door lock apparatus of the present invention uses an electrically operated locking mechanism having as its heart an electromagnetic actuator 20. The electromagnetic actuator 20 is powered by a hollow cylindrical solenoid 22 having a pair of wires 24 extending therefrom. The solenoid 22 is mounted inside a iron housing 26 which has a circular opening 27 at a first end (illustrated at the bottom of each of FIGS. 1 through 4), and which has an U-shaped opening 28 in one side thereof. Note that the solenoid 22 does not quite extend to the first end of the iron housing 26.

The iron housing 26 also has an aperture 30 located in a second end thereof opposite the first end thereof. Located in the top side of the iron housing 26 are two threaded apertures 32, while located in the bottom side of the iron housing 26 are two threaded apertures 34. Either the threaded apertures 32 or the threaded apertures 34 will be used to mount the electromagnetic actuator 20 in a lock housing (not shown in FIGS. 1 through 4).

Located inside the solenoid 22 is a thin, hollow, cylindrical brass sleeve 36 which extends slightly out of the first end of the iron housing 26. The cylindrical brass sleeve 36 is retained within the solenoid 22 either by a close fit (as shown), or, alternately, by an outwardly extending flange extending therefrom (not shown herein) which would be located behind the solenoid 22.

Located within the iron housing 26 adjacent the second end thereof is an armature stop member 38, which has a cylindrical outer surface and a frustroconical inner surface with the larger diameter being oriented toward the first end of the iron housing 26. The armature stop member 38 extends for less than half of the length of the solenoid 22. Extending from the end of the armature stop member 38 adjacent the second end of the iron housing 26 is a smaller diameter hollow cylindrical segment 40 which extends through the aperture 30 at the second end of the iron housing 26. An end cap 42 is mounted in the circular opening 27 at the first end of the iron housing 26, and has a large aperture 44 located centrally therein through which the cylindrical brass sleeve 36 protrudes.

An iron armature 46 is provided which is essentially cylindrical in configuration, with an outwardly extending flange 48 being located at a first end thereof and a frustroconical segment 50 being located at a second end thereof opposite the first end. The frustroconical segment 50 tapers to a smaller diameter at the second end of the iron armature 46, and has a threaded aperture 52 located centrally therein. A shaft 54 has a first end which is threaded and screwed into the threaded aperture 52 of the frustroconical segment 50 of the iron armature 46. A second end of the shaft 54 (which may be thought of as its free end) extends through the cylindrical segment 40 of the armature stop member 38, and thus extends from the second end of the iron housing 26.

A circular flange 56 extends from the second or free end of the shaft 54, and a circular flange 58 is spaced away from the circular flange 56 by a short shaft segment 60. On the first end of the iron armature 46 at which the outwardly extending flange 48 is located, a circular flange 62 is mounted centrally thereto using a short shaft segment 64.

Completing the construction of the electromagnetic actuator 20 is a spring 66, which is mounted on the iron armature 46 between the outwardly extending flange 48 on the iron armature 46 and the end cap 42. The spring 66 biases the iron armature 46 outwardly from the first end of the iron housing 26, where it will remain as long as the solenoid 22 is not energized; note that in this position, the second or free end of the shaft 54 is located just outside the second end of the iron housing 26. When the solenoid 22 is energized, the iron armature 46 will be drawn into the solenoid 22 and the first end of the iron housing 26, while the second or free end of the shaft 54 will extend further out of the second end of the iron housing 26.

Referring next to FIG. 5, a locking member 70 is illustrated which is made of flat stock. The locking member 70 may be thought of as a rectangular segment 72 having a guide tab 74 extending from the top side thereof and a guide tab 76 extending from the bottom side thereof. Note that the guide tab 76 is slightly longer than the guide tab 74. As illustrated in FIG. 5, the left side of the rectangular segment 72 will be the engaging portion of the locking member 70. Completing the construction of the locking member 70 are two spaced-apart apertures 78 which extend through the rectangular segment 72.

Referring now to FIG. 6, a retaining member 80 is illustrated which is also made of flat stock. The retaining member 80 consists of a rectangular segment 82 having an L-shaped engaging arm 84 extending therefrom, with the free end of the base of the L being attached to the side of the rectangular segment 82 at the bottom thereof. The leg of the L is accordingly parallel to and spaced away from the rectangular segment 82. Completing the construction of the retaining member 80 are two spaced-apart apertures 86 which extend through the rectangular segment 72.

Referring next to FIGS. 7 and 8, the assembly of two of the retaining members 80 onto opposite sides of the locking member 70 is illustrated. Two screws 88 extend through the apertures 86 in one of the retaining members 80, the apertures 78 in the locking member 70, and the apertures 86 in the other of the retaining members 80. Two nuts 90 are then installed onto the screws 88 to retain the assembled locking member 70 and retaining members 80 together. Note that the tops and bottoms of the rectangular segments 82 are coincident with the top and bottom of the rectangular segment 72, thereby separating the guide tabs 74 and 76 from the rectangular segment 72.

Figure 10:
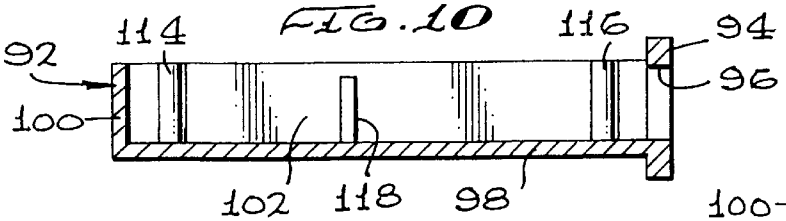
FIG. 10 is a cross-sectional view of the lock housing illustrated in FIG. 9, showing an aperture through which a latch bolt will extend.

Referring now to FIGS. 9 and 10, a lock housing 92 which is open on one side thereof is illustrated. Located on one side of the lock housing 92 is a flange plate 94 which will be flush with a door (not illustrated herein) in which the lock housing 92 is installed. Located in the flange plate 94 is a rectangular aperture 96 through which a latch bolt (not illustrated in FIGS. 9 and 10) will extend. The rest of the lock housing 92 is formed by a flat rectangular plate member 98 having a side wall 100, a top wall 102, and a bottom wall 104.

A segment 106 is removed from the plate member 98 and the bottom wall 104 to provide a location through which the wires 24 from the electromagnetic actuator 20 (illustrated in FIGS. 1 through 4) may be routed. A circular aperture 108 is located in the plate member 98 to mount a latch actuating cam member (not illustrated in FIGS. 9 and 10) therein. A slot 110 is located in the plate member 98 in a radial orientation with respect to the aperture 108, and is also spaced away from the aperture 108. The slot 110 will receive the guide tab 76 of the locking member 70 (illustrated in FIGS. 5, 7, and 8) therein. Two apertures 112 are located in the plate member 98 on opposite sides of the radius of the aperture 108 on which the slot 110 is located.

A pivot post 114 extends from the plate member 98 near to the intersection of the side wall 100 and the bottom wall 104. Four other posts 116 extend from the plate member 98 in various locations therein. The pivot post 114 and the posts 116 are all as high as the side wall 100, the top wall 102, and the bottom wall the bottom wall 104, and all have threaded apertures 117 located therein. Also extending from the plate member 98 are two spaced-apart latch support posts 118. The latch support posts 118 are on opposite sides of an axis defining the center of the rectangular aperture 96. While other apertures, slots, etc. are illustrated in the lock housing 92, they do not relate to the portion of the electrically operable door lock apparatus defining the present invention, and accordingly will not be discussed.

Figure 11:
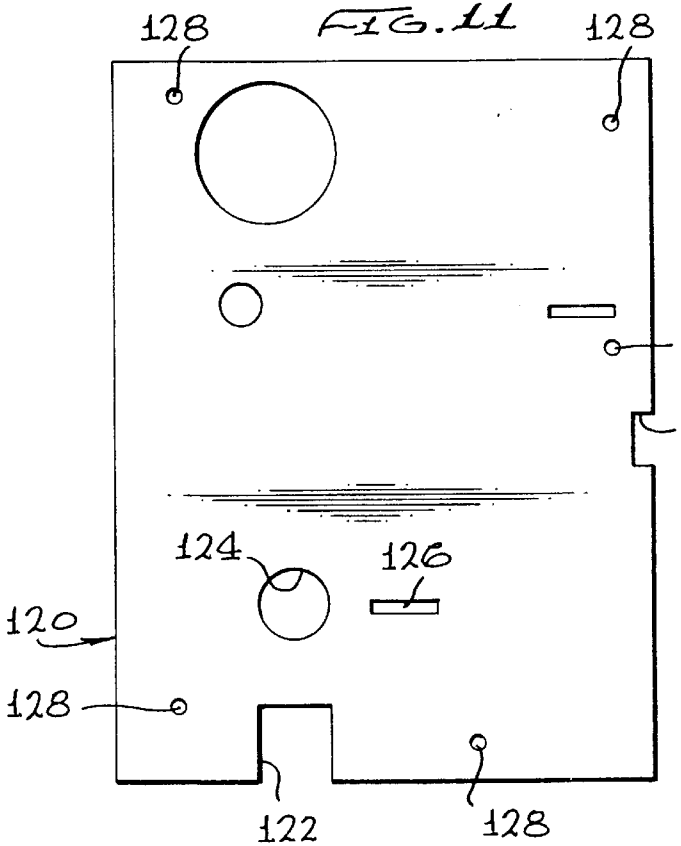
FIG. 11 is a plan view of a lock cover for use to enclose the open side of the lock housing illustrated in FIG. 9.

Referring now to FIG. 11, a lock cover 120 for use to enclose the open side of the lock housing 92 illustrated in FIGS. 9 and 10 is illustrated. The lock cover 120 has a segment 122 removed therefrom (corresponding to the segment 106 removed from the plate member 98 and the bottom wall 104 as illustrated in FIG. 9) to provide a location through which the wires 24 from the electromagnetic actuator 20 (illustrated in FIGS. 1 through 4) may be routed. A circular aperture 124 is located in the lock cover 120 (correlating exactly with the aperture 108 in the lock housing 92 illustrated in FIG. 9) to mount a latch actuating cam member (not illustrated in FIGS. 9 and 10) therein. A slot 126 is located in the plate member 98 (closely correlating with the slot 110 in the lock housing 92 illustrated in FIG. 9) in a radial orientation with respect to the aperture 108, and is also spaced away from the aperture 108. The slot 126 will receive the guide tab 74 of the locking member 70 (illustrated in FIGS. 5, 7, and 8) therein.

Also located in the lock cover 120 are five apertures 128 which correlate with the threaded apertures 117 located in the pivot post 114 and the four posts 116 (illustrated in FIG. 9). Screws (not illustrated herein) will be inserted through the apertures 128 and into the threaded apertures 117 to retain the lock cover 120 in place on the lock housing 92. A notch 130 is located in the side of the lock cover 120 at a location under which the latch bolt (not illustrated in FIG. 11) will slide. While other apertures, slots, etc. are illustrated in the lock cover 120, they do not relate to the portion of the electrically operable door lock apparatus defining the present invention, and accordingly will not be discussed.

Figure 12:
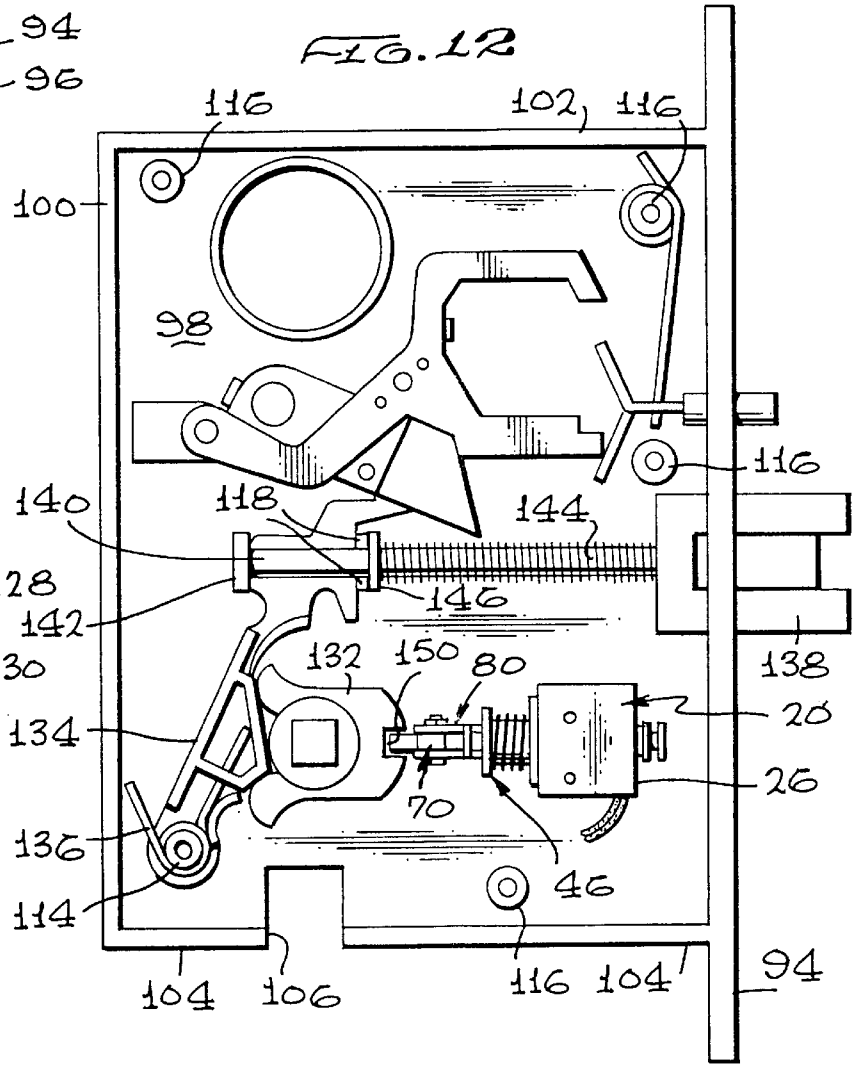
FIG. 12 is a plan view showing the installation of the latch bolt opening mechanism including a latch actuating cam member into the lock housing illustrated in FIG. 9, and also showing the assembled locking and retaining members illustrated in FIGS. 7 and 8 installed to be driven by the electromagnetic actuator illustrated in FIGS. 1 through 4.

Referring next to FIG. 12, the lock housing 92 as illustrated in FIG. 9 is shown with a number of components installed therein. A latch actuating cam member 132 is illustrated to be mounted inside the lock housing 92 in a manner allowing for rotation about a fixed axis defined by the aperture 108 in the lock housing 92 (illustrated in FIG. 9) and the aperture 124 in the lock cover 120 (illustrated in FIG. 11). The latch actuating cam member 132 is shown to have a rectangular aperture located therein, which rectangular aperture will accept a rectangular driver spindle (not illustrated herein) therein as is conventional. The latch actuating cam member 132 may accordingly be rotated whenever a knob or handle (not illustrated herein) located on an end of the rectangular driver spindle is turned.

It may be seen that the latch actuating cam member 132 has two cam elements located thereon, both of which bear against a latch actuating arm 134. The latch actuating arm 134 has a first end which is rotatably mounted on the pivot post 114 extending from the lock housing 92. The latch actuating arm 134 is biased in a clockwise direction (as viewed in FIG. 12) by a spring 136. When the latch actuating cam member 132 is rotated (in either direction), it will urge the latch actuating arm 134 to rotate counterclockwise (as viewed in FIG. 12) against the force of the spring 136 such that a second end of the latch actuating arm 134 moves from a first position to a second position (from right to left as viewed in FIG. 12).

A latch bolt 138 is mounted at a first end of a latch bolt actuating shaft 140 which has a flange 142 mounted at a second end thereof opposite the first end. The flange 142 extends through the rectangular aperture 96 in the flange plate 94 (illustrated in FIGS. 9 and 10). The latch bolt actuating shaft 140 is located between and retained in place by the latch support posts 118.

A spring 144 is located on the latch bolt actuating shaft 140, and a washer 146 is located on the latch bolt actuating shaft 140 between the spring 144 and the flange 142. The washer 146 is placed on the side of the latch support posts 118 facing the flange plate 94, and the spring 144 thus bears on the washer 146 and the latch support posts 118 on one end thereof, and on the latch bolt 138 on the other end thereof, thereby biasing the latch bolt 138 into a deployed position in which it extends from the lock housing 92.

The second end of the latch actuating arm 134 bears against the flange 142, and when the latch actuating arm 134 moves from its first position to its second position (from right to left as viewed in FIG. 12), the second end of the latch actuating arm 134 engages the flange 142 to cause the latch bolt actuating shaft 140 to draw the latch bolt 138 into the lock housing 92 into a retracted position. Thus, rotation of the latch actuating cam member 132 will cause the latch actuating arm 134 to draw the latch bolt 138 from its deployed direction to its retracted position, disengaging the latch bolt 138 from engagement with a strike plate in a door frame (not illustrated herein) and allowing the door (not illustrated herein) to be freely opened.

Referring again to the latch actuating cam member 132, it may be seen that a notch 150 is located in the side thereof which is opposite the location of the two cam elements and their point of engagement with the latch actuating arm 134. The assembled locking member 70 and retaining members 80 are installed into the lock housing 92 with the guide tab 76 of the locking member 70 installed into the slot 110 in the lock housing 92 (illustrated in FIG. 9), and with the guide tab 74 of the locking member 70 installed into the slot 126 in the lock cover 120 (illustrated in FIG. 11, and installed onto the lock housing 92).

It will be readily apparent to those skilled in the art that since the lengths of the slots 110 and 126 are longer than the widths of the guide tabs 76 and the guide tab 74, respectively, the assembled locking member 70 and retaining members 80 can reciprocate toward and away from the latch actuating cam member 132. Thus, the notch 150 in the latch actuating cam member 132 may be selectively engaged by or disengaged from the rectangular segment 72 of the locking member 70 as the assembled locking member 70 and retaining members 80 reciprocate.

Figure 2:
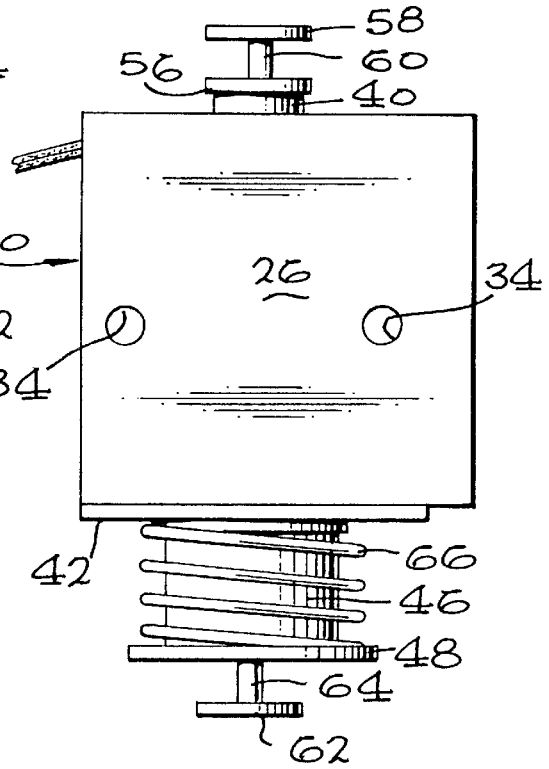
FIG. 2 is a bottom plan view of the electromagnetic actuator illustrated in FIG. 1, showing a pair of threaded apertures located in the bottom side of the iron housing.
Figure 3:
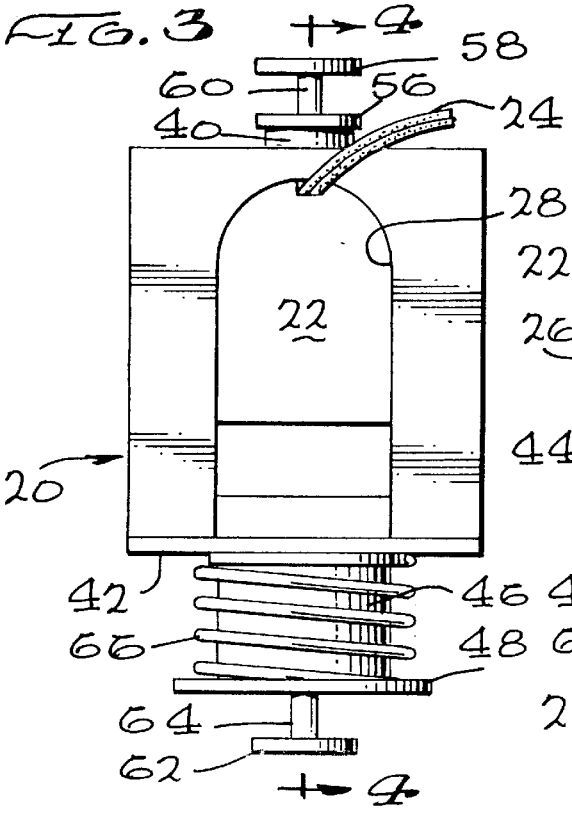
FIG. 3 is a side view of the electromagnetic actuator illustrated in FIGS. 1 and 2, showing the solenoid coil located inside the iron housing.
Figure 4:
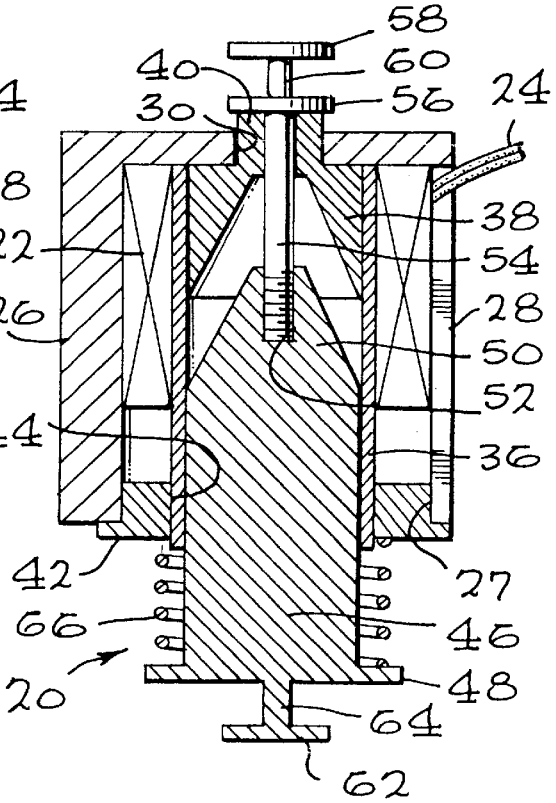
FIG. 4 is a cross-sectional view of the electromagnetic actuator illustrated in FIGS. 1 through 3 with the solenoid being shown schematically, showing the configuration of the armature and the mounting of the shaft onto the armature.

The assembled locking member 70 and retaining members 80 are driven by the electromagnetic actuator 20, which is installed into the lock housing 92 using a pair of screws (not illustrated herein) which extend through the apertures 112 in the lock housing 92 (illustrated in FIG. 9) and then into either the threaded apertures 32 on the top side of the iron housing 26 (illustrated in FIG. 1) or the threaded apertures 34 on the bottom side of the iron housing 26 (illustrated in FIG. 2). Thus, either the iron armature 46 of the electromagnetic actuator 20 or the shaft 54 of the electromagnetic actuator 20 will be used to drive the assembled locking member 70 and retaining members 80.

Figure 14:
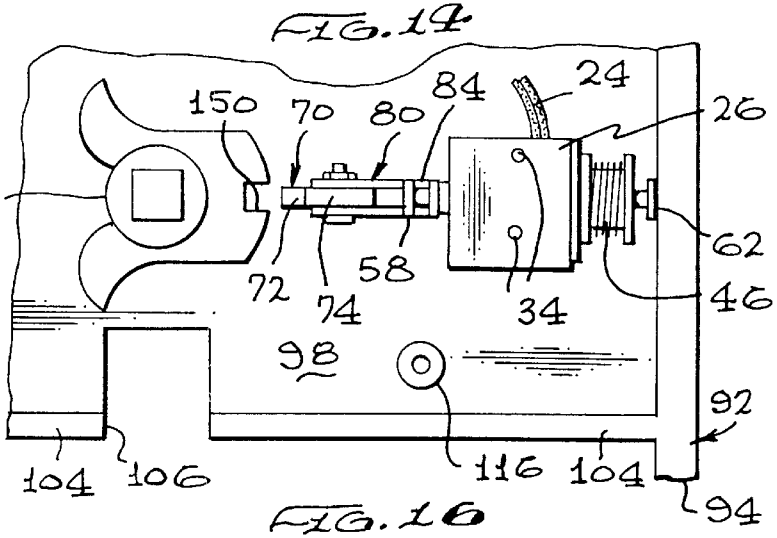
FIG. 14 is a plan view of a portion of the electrically operable door lock apparatus illustrated in FIG. 12, with the armature engaged to drive the locking member and with the solenoid being energized.
Figure 16:
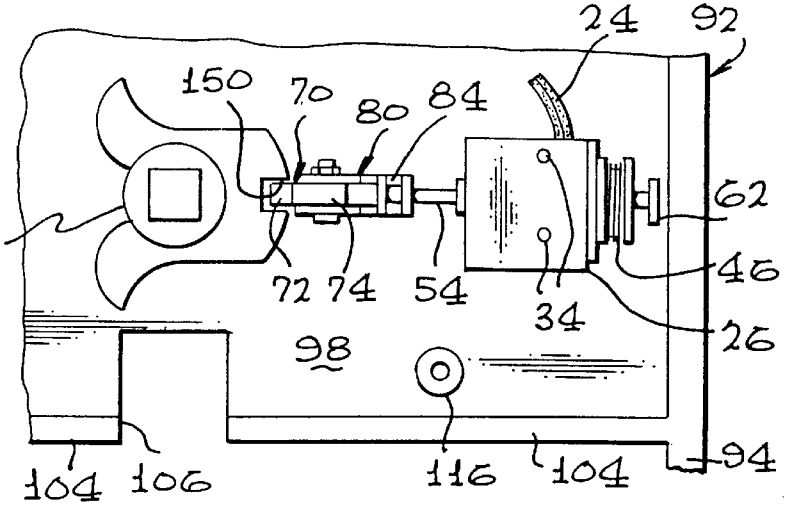
FIG. 16 a plan view of a portion of the electrically operable door lock apparatus illustrated in FIG. 12, with the free end of the shaft engaged to drive the locking member and with the solenoid being energized.
Figure 13:
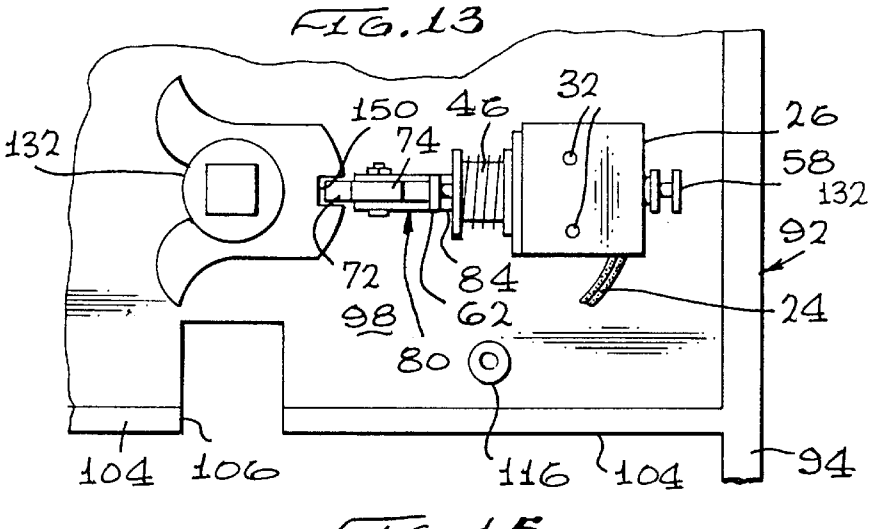
FIG. 13 is a plan view of a portion of the electrically operable door lock apparatus illustrated in FIG. 12, with the armature engaged to drive the locking member and with the solenoid nots being energized.
Figure 15:
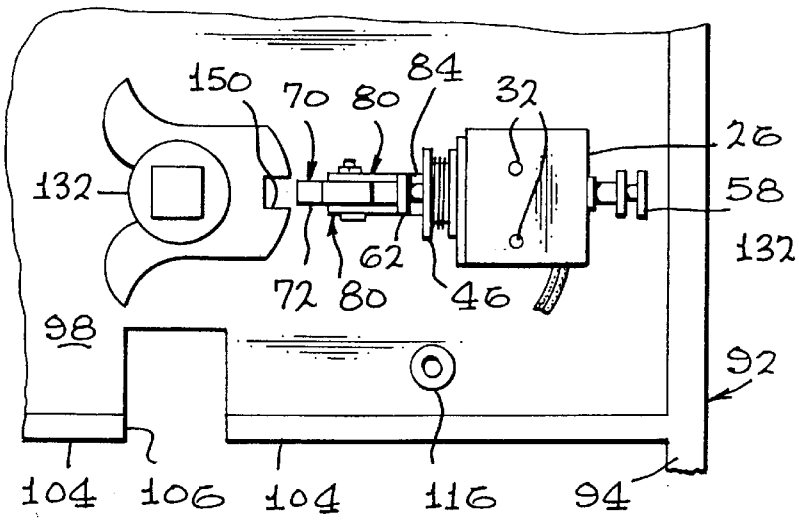
FIG. 15 is a plan view of a portion of the electrically operable door lock apparatus illustrated in FIG. 12, with the free end of the shaft engaged to drive the locking member and with the solenoid not being energized.

These two options will be fully discussed in conjunction with FIGS. 13 and 14, in which the iron armature 46 of the electromagnetic actuator 20 is used to drive the assembled locking member 70 and retaining members 80, or in FIGS. 15 and 16, in which the shaft 54 of the electromagnetic actuator 20 is used to drive the assembled locking member 70 and retaining members 80. While various other apparatus is illustrated as being installed in the lock housing 92, it does not relate to the portion of the electrically operable door lock apparatus defining the present invention, and accordingly will not be discussed.

Referring first to FIGS. 13 and 14, the iron housing 26 is mounted to the plate member 98 of the lock housing 92 using the threaded apertures 34 on the bottom of the iron housing 26. The iron armature 46 of the electromagnetic actuator 20 is used to drive the assembled locking member 70 and retaining members 80 by engaging the circular flange 62 (which extends from the iron armature 46) with the L-shaped engaging arms 84 of the retaining members 80. Thus, as the iron armature 46 is driven in reciprocating motion within the solenoid 22 (illustrated in FIGS. 3 and 4) of the electromagnetic actuator 20, the assembled locking member 70 and retaining members 80 will be driven in reciprocating motion to selectively engage or be disengaged from the notch 150 in the latch actuating cam member 132.

Referring first to FIG. 13, the electromagnetic actuator 20 is illustrated with the solenoid 22 not being energized. Accordingly, the iron armature 46 has not been drawn into the iron housing 26, and the locking member 70 is in engagement with the notch 150 in the latch actuating cam member 132 to thereby maintain the electrically operable door lock apparatus of the present invention in a locked position. Referring next to FIG. 14, the electromagnetic actuator 20 is illustrated with the solenoid 22 being energized. Accordingly, the iron armature 46 has been drawn into the iron housing 26, and the locking member 70 is no longer in engagement with the notch 150 in the latch actuating cam member 132 to thereby maintain the electrically operable door lock apparatus of the present invention in an unlocked position.

Thus, by using the iron armature 46 to drive the locking member 70, the locking member 70 will be in its locked position when the solenoid 22 is not energized, and will be driven to its unlocked position when the solenoid 22 is energized. This mode of operation is referred to as the fail secure mode, since if there is a power failure, the electrically operable door lock apparatus of the present invention will be locked.

Referring now to FIGS. 15 and 16, the iron housing 26 is mounted to the plate member 98 of the lock housing 92 using the threaded apertures 32 on the top of the iron housing 26. The shaft 54 of the electromagnetic actuator 20 is used to drive the assembled locking member 70 and retaining members 80 by engaging the circular flange 58 (which extends from the shaft 54) with the L-shaped engaging arms 84 of the retaining members 80. Thus, as the shaft 54 is driven in reciprocating motion within the solenoid 22 (illustrated in FIGS. 3 and 4) of the electromagnetic actuator 20, the assembled locking member 70 and retaining members 80 will be driven in reciprocating motion to selectively engage or be disengaged from the notch 150 in the latch actuating cam member 132.

Referring first to FIG. 15, the electromagnetic actuator 20 is illustrated with the solenoid 22 not being energized. Accordingly, the shaft 54 is fully drawn into the iron housing 26, and the locking member 70 is not in engagement with the notch 150 in the latch actuating cam member 132 to thereby maintain the electrically operable door lock apparatus of the present invention in an unlocked position. Referring next to FIG. 16, the electromagnetic actuator 20 is illustrated with the solenoid 22 being energized. Accordingly, the shaft 54 is fully extended from the iron housing 26, and the locking member 70 is fully in engagement with the notch 150 in the latch actuating cam member 132 to thereby maintain the electrically operable door lock apparatus of the present invention in a locked position.

Thus, by using the shaft 54 to drive the locking member 70, the locking member 70 will be in its unlocked position when the solenoid 22 is not energized, and will be driven to its locked position when the solenoid 22 is energized. This mode of operation is referred to as the fail safe mode, since if there is a power failure, the electrically operable door lock apparatus will be unlocked.

It may therefore be appreciated from the above detailed description of the preferred embodiment of the present invention that it teaches an electrically operable door lock apparatus, and a method for the operation thereof, which may be installed into a standard door in place of a regular lockset. The electrically operable door lock apparatus of the present invention comprises a single module which may be easily installed in the conventional manner into a door (save for the installation of a pair of wires), with a standard strike plate (and no other apparatus) being mounted in the door frame. The electrically operable door lock apparatus of the present invention may be operated by turning a knob or handle in a manner like that of a conventional lockset, except that the use of the knob or handle to open the door may be selectively enabled or disabled through the use of the electrical locking mechanism.

The electrically operable door lock apparatus of the present invention is also selectively adaptable to operate in either a fail safe mode of operation in which the door will be locked when electrical power is supplied to the door lock apparatus and unlocked when electrical power is not supplied, or a fail secure mode of operation in which the door will be unlocked when electrical power is supplied to the door lock apparatus and locked when electrical power is not supplied. These two alternate modes of operation are user selectable prior to installation of the electrically operable door lock apparatus of the present invention into the door without requiring the use of additional or alternate components. The selection of the operating mode of choice is relatively easy to accomplish in the electrically operable door lock apparatus of the present invention, with only simple hand tools being required.

The electrically operable door lock apparatus of the present invention is of a construction which is both durable and long lasting, and which will require little or no maintenance throughout its operating lifetime. The electrically operable door lock apparatus of the present invention is also of inexpensive construction to enhance its market appeal and to thereby afford it the broadest possible market. Finally, all of the aforesaid advantages and objectives of the electrically operable door lock apparatus of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. An electrically operable door lock apparatus for installation into a door hingedly mounted in a door frame having a striker plate mounted in a side thereof, said door lock apparatus comprising:

a lock housing member for installation into the door;

a latch bolt installed for movement in said lock housing member between a deployed position in which said latch bolt extends out of said lock housing member and is engaged by the strike plate if the door is closed, and a retracted position in which said latch bolt is contained entirely within said lock housing member such that it may not engage the strike plate;

a latch actuating mechanism for movement between a first position in which said latch bolt will be deployed and a second position in which said latch bolt will be retracted by said latch actuating mechanism;

a locking member moveable between a first position in which said locking member is disengaged from said latch actuating mechanism and a second position in which said locking member engages said latch actuating mechanism in its first position and prevents it from being moved to its second position; and an electromagnetic actuator for driving said locking member into one of its first and second positions when electromagnetic actuator is energized, and the other of said locking member's first and second positions when said electromagnetic actuator is not energized, wherein said electromagnetic actuator comprises:

a stationary member for installation into said lock housing member in either a first position or a second position;

a moveable member installed for movement between a first position when said electromagnetic actuator is electrically energized, and a second position when said electromagnetic actuator is not electrically energized, wherein said moveable member has first and second opposite ends, said first end of said moveable member extending from a first side of said stationary member and comprising first means for engaging said locking member, and said second end of said moveable member extending from a second side of said stationary member opposite said first side of said stationary member and comprising second means for engaging said locking member, wherein when said moveable member is in said first position, said first end of said moveable member is retracted inwardly toward said first side of said stationary member and said second end of said moveable member is extended outwardly from said second side of said stationary member; and a spring for biasing said moveable member from said first position into said second position;

wherein, if said stationary member is installed into said lock housing member in said first position, said first end of said moveable member is oriented toward said locking member and said first engaging means engages said locking member to drive said locking member from said second position of said locking member to said first position of said locking member when said electromagnetic actuator is electrically energized, said locking member being in said second position when said electromagnetic actuator is not electrically energized; and wherein, if said stationary member is installed into said lock housing member in said second position, said second end of said moveable member is oriented toward said locking member and said second engaging means engages said locking member to drive said locking member from said first position of said locking member to said second position of said locking member when said electromagnetic actuator is electrically energized, said locking member being in said first position when said electromagnetic actuator is not electrically energized.

2. An electrically operable door lock apparatus as defined in claim 1, additionally comprising:

a spring for biasing said latch bolt into said deployed position.

3. An electrically operable door lock apparatus as defined in claim 1, wherein said latch actuating mechanism comprises:

a latch actuating cam member which is mounted inside said lock housing member in a manner allowing said latch actuating cam member to rotate about a fixed axis, said latch actuating cam being rotatable between a first angular position in which said latch bolt will be deployed and a second angular position in which said latch bolt will be retracted.

4. An electrically operable door lock apparatus as defined in claim 3, wherein said latch actuating cam is also rotatable between said first angular position in which said latch bolt will be deployed and a third angular position in which said latch bolt will be retracted, said second and third angular positions of said latch actuating cam being in opposite directions of rotation relative to said first angular position of said latch actuating cam.

5. An electrically operable door lock apparatus as defined in claim 3, wherein said latch actuating cam member has a rectangular aperture located therein, said rectangular aperture for accepting a rectangular driver member of the type having a knob or handle mounted thereupon for use in rotating said latch actuating cam member.

6. An electrically operable door lock apparatus as defined in claim 3, wherein said lock housing member has a pivot post mounted therein, said electrically operable door lock apparatus additionally comprising:

a latch actuating arm having a first end which is rotatably mounted on said pivot post mounted in said lock housing member, said latch actuating arm also having a second end opposite said first end;

a spring for biasing said latch actuating arm in a first direction, said latch actuating cam member bearing against said latch actuating arm and tending to cause said latch actuating arm to rotate in a second direction opposite from said first direction such that said second end of said latch actuating arm moves from a first position to a second position when said latch actuating cam member is rotated in either direction; and a latch bolt actuating shaft having said latch bolt mounted at a first end thereof and a flange mounted at a second end thereof opposite the first end, said second end of said latch actuating arm bearing against said flange and causing said latch bolt to move from said deployed position to said retracted position when said latch actuating arm moves from said first position to said second position.

7. An electrically operable door lock apparatus as defined in claim 3, wherein said latch actuating cam member comprises:

a notch located in a side thereof, wherein said locking member engages said notch in said latch actuating cam member to prevent said latch actuating cam member from rotating from said first angular position to said second angular position when said locking member is in said first position, and wherein said locking member does not engage said notch in said latch actuating cam member when said locking member is in said second position.

8. An electrically operable door lock apparatus as defined in claim 1, wherein said locking member comprises:

a flat rectangular segment having a first guide tab extending from a first side thereof and a second guide tab extending from a second side thereof opposite said first side of said rectangular segment;

and wherein said lock housing member comprises:

first and second slots disposed in parallel fashion in opposite sides of said lock housing member, said first guide tab of said rectangular segment being located in said first slot and said second guide tab of said rectangular segment being located in said second slot, said first and second slots being longer than said first and second guide tabs are wide, said locking member thereby being moveable in reciprocating fashion.

9. An electrically operable door lock apparatus as defined in claim 1, wherein said electromagnetic actuator drives said locking member into its first position when electromagnetic actuator is energized, and its second position when said electromagnetic actuator is not energized.

10. An electrically operable door lock apparatus as defined in claim 1, wherein said electromagnetic actuator drives said locking member into its second position when electromagnetic actuator is energized, and its first position when said electromagnetic actuator is not energized.

11. An electrically operable door lock apparatus as defined in claim 1, wherein said stationary member comprises:

an iron housing; and a hollow cylindrical solenoid mounted inside said iron housing.

12. An electrically operable door lock apparatus as defined in claim 11, wherein said moveable member comprises:

a cylindrical iron armature having a first end and a second end;

a shaft having a first end and a second end, said first end of said shaft being mounted onto said second end of said iron armature, wherein said first end of said moveable member comprises said first end of said iron armature, and wherein said second end of said shaft comprises said second end of said moveable member.

13. An electrically operable door lock apparatus as defined in claim 11, wherein said iron housing comprises:

a first plurality of threaded apertures located on a top side thereof; and a second plurality of threaded apertures located on a bottom side thereof; and wherein said lock housing member comprises:

a plurality of apertures located therein, wherein said second plurality of apertures in said iron housing are used in conjunction with said plurality of apertures in said lock housing to mount said stationary member in said lock housing member in said first position, and wherein said first plurality of apertures in said iron housing are used in conjunction with said plurality of apertures in said lock housing to mount said stationary member in said lock housing member in said second position.

14. An electrically operable door lock apparatus for installation into a door hingedly mounted in a door frame having a striker plate mounted in a side thereof, said door lock apparatus comprising:

a lock housing member for installation into the door;

a latch bolt installed for movement in said lock housing member between a deployed position in which said latch bolt extends out of said lock housing member and is engaged by the strike plate if the door is closed, and a retracted position in which said latch bolt is contained entirely within said lock housing member such that it may not engage the strike plate;

means for biasing said latch bolt into said deployed position;

a latch actuating cam member which is mounted inside said lock housing member in a manner allowing said latch actuating cam member to rotate about a fixed axis, said latch actuating cam being rotatable between a first angular position and a second angular position, said latch actuating cam member having a notch located in a side thereof;

a latch actuating mechanism for movement between a first position in which said latch bolt will be deployed and a second position in which said latch bolt will be retracted by said latch actuating mechanism, said latch actuating mechanism being driven from said first position of said latch actuating mechanism to said second position of said latch actuating mechanism when said latch actuating cam is rotated from said first angular position to said second angular position;

a locking member moveable between a first position in which said locking member is disengaged from said latch actuating cam member and a second position in which said locking member engages said notch in said latch actuating cam member when said latch actuating cam member is in its first position and prevents said latch actuating cam member from being moved to its second position; and an electromagnetic actuator for driving said locking member into one of its first and second positions when electromagnetic actuator is electrically energized, and the other of said locking member's first and second positions when said electromagnetic actuator is not electrically energized, wherein said electromagnetic actuator comprises:

a stationary member for installation into said lock housing member in either a first position or a second position;

a moveable member installed for movement between a first position when said electromagnetic actuator is electrically energized, and a second position when said electromagnetic actuator is not electrically energized, wherein said moveable member has first and second opposite ends, said first end of said moveable member extending from a first side of said stationary member and comprising first means for engaging said locking member, and said second end of said moveable member extending from a second side of said stationary member opposite said first side of said stationary member and comprising second means for engaging said locking member, wherein when said moveable member is in said first position, said first end of said moveable member is retracted inwardly toward said first side of said stationary member and said second end of said moveable member is extended outwardly from said second side of said stationary member; and a spring for biasing said moveable member from said first position into said second position;

wherein, if said stationary member is installed into said lock housing member in said first position, said first end of said moveable member is oriented toward said locking member and said first engaging means engages said locking member to drive said locking member from said second position of said locking member to said first position of said locking member when said electromagnetic actuator is electrically energized, said locking member being in said second position when said electromagnetic actuator is not electrically energized; and wherein, if said stationary member is installed into said lock housing member in said second position, said second end of said moveable member is oriented toward said locking member and said second engaging means engages said locking member to drive said locking member from said first position of said locking member to said second position of said locking member when said electromagnetic actuator is electrically energized, said locking member being in said first position when said electromagnetic actuator is not electrically energized.

* * * * *